US007195073B2

(12) United States Patent
Fraser, III

(10) Patent No.: US 7,195,073 B2
(45) Date of Patent: Mar. 27, 2007

(54) EXPANDABLE TIEBACK

(75) Inventor: James M. Fraser, III, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 177 days.

(21) Appl. No.: 10/427,563

(22) Filed: May 1, 2003

(65) Prior Publication Data

US 2004/0216889 A1 Nov. 4, 2004

(51) Int. Cl.
*E21B 19/16* (2006.01)
*E21B 17/08* (2006.01)

(52) U.S. Cl. ..... 166/380; 166/384; 166/242.6; 166/207

(58) Field of Classification Search ..... 166/380, 166/382, 208, 115, 250.01, 255.1, 384, 206, 166/207, 242.6, 242.1
See application file for complete search history.

(56) References Cited

U.S. PATENT DOCUMENTS

| | | | | |
|---|---|---|---|---|
| 3,712,376 | A * | 1/1973 | Owen et al. | 166/277 |
| 3,776,307 | A | 12/1973 | Young | |
| 4,681,159 | A | 7/1987 | Allwin et al. | |
| 4,942,925 | A | 7/1990 | Themig | |
| 5,095,991 | A * | 3/1992 | Milberger | 166/380 |
| 5,148,870 | A | 9/1992 | Fernandez et al. | |
| 5,330,001 | A | 7/1994 | Baugh et al. | |
| 5,335,729 | A * | 8/1994 | Turner et al. | 166/380 |
| 5,566,761 | A | 10/1996 | Pallini, Jr. et al. | |
| 5,775,427 | A | 7/1998 | Skeels et al. | |
| 6,098,717 | A | 8/2000 | Bailey et al. | |
| 6,390,201 | B1 * | 5/2002 | Coon et al. | 166/380 |
| 6,446,724 | B2 * | 9/2002 | Baugh et al. | 166/285 |
| 6,470,966 | B2 * | 10/2002 | Cook et al. | 166/207 |
| 6,550,539 | B2 * | 4/2003 | Maguire et al. | 166/380 |
| 6,629,567 | B2 * | 10/2003 | Lauritzen et al. | 166/380 |
| 6,702,029 | B2 * | 3/2004 | Metcalfe et al. | 166/378 |
| 6,843,322 | B2 * | 1/2005 | Burtner et al. | 166/382 |
| 6,907,652 | B1 * | 6/2005 | Heijnen | 29/447 |
| 2002/0166668 | A1 | 11/2002 | Metcalfe et al. | |
| 2004/0238181 | A1 * | 12/2004 | Cook et al. | 166/378 |

FOREIGN PATENT DOCUMENTS

| | | |
|---|---|---|
| GB | 2830213 A | 4/2003 |
| WO | PCT/GB00/03406 | 3/2001 |

* cited by examiner

*Primary Examiner*—Kenneth Thompson
(74) *Attorney, Agent, or Firm*—Steve Rosenblatt

(57) ABSTRACT

A tie back assembly that uses expansion for connection and sealing is disclosed. The male component does not have any wall portions removed to hold a resilient seal. A seal is an option as anchoring and sealing can be accomplished by the expansion alone. The pressure rating of the connection is not reduced by material removed to accommodate a seal. A variety of expansion techniques can be used and the expansion can be done in a single trip with the insertion of the tie back assembly into the receptacle or in a separate trip.

28 Claims, 4 Drawing Sheets

EXPANDABLE TIEBACK

FIELD OF THE INVENTION

The field of this invention is a seal or anchor assembly that can be inserted into a downhole seal bore and seal or anchor a tubing string to the bore as a result of expansion.

BACKGROUND OF THE INVENTION

Seal bores have been in use to allow a string to be lowered downhole and secured and sealed. Typically, a packer or plug has a polished bore in it to act as the receptacle for the lower end of a string run into the well from the surface after the packer or plug is set. At the lower end of the string is what is known as a tieback seal assembly. This assembly comprised a male component to go into the female seal bore. There is a single or multiple grooves on the male component to hold a seal. The seal can be an o-ring or a stack of chevron shaped rings. Regardless of the nature of the seal material used, there is an interference fit between the seal material and the surrounding bore to energize the seal material in the seal bore. Frequently, the seal bore is polished to minimize damage to the seal assembly during the insertion process. At times, guides or centralizers are used to assist in the alignment of the male component with the seal into the seal bore. One such device is illustrated in U.S. Pat. No. 5,330,001. Other art, such as U.S. Pat. Nos. 6,098,717 and 6,446,724 illustrate expanding one tubular into another.

Typically, the seal or seals are placed in a groove in the tieback assembly male component. The removal of metal that is necessary to form the groove or grooves for holding the seal or seals takes away a portion of the wall and reduces the pressure rating of the connection. What is needed and has not previously been provided is a connection that removes this pressure rating reduction due to the presence of the groove or grooves to hold a seal or seals. The present invention addresses this need by providing a tieback assembly where wall portions are not removed to provide a mounting location for a seal or seals. Instead, the concept of expansion in place is used. Where a seal is actually used, it can be in the form of an exterior coating that gets forced into contact with the seal bore receptacle as a result of expansion. Sealing or anchoring with metal-to-metal contact without the use of resilient seals is contemplated using the expansion technique. These and other advantages of the present invention will become more apparent to those skilled in the art from a review of the description of the preferred embodiment and the claims, which appear below.

SUMMARY OF THE INVENTION

A tie back assembly that uses expansion for connection and sealing is disclosed. The male component does not have any wall portions removed to hold a resilient seal. A seal is an option as anchoring and sealing can be accomplished by the expansion alone. The pressure rating of the connection is not reduced by material removed to accommodate a seal. A variety of expansion techniques can be used and the expansion can be done in a single trip with the insertion of the tie back assembly into the receptacle or in a separate trip. Grip enhancing features are possible as is a temporary seal to give a surface signal that the connection is made prior to expansion. The tieback an be movably secured to the liner top to allow pulling out the seals without disconnection of the joint to permit cement delivery into the joint prior to reinsertion of the seals before the cement sets.

DETAILED DESCRIPTION OF THE PREFERRED EMBODIMENT

Figure 1:
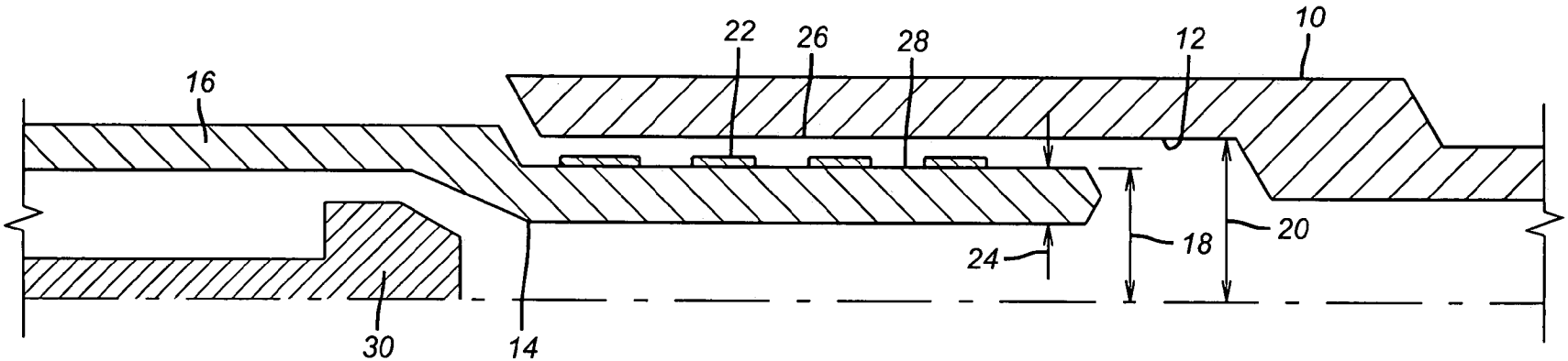
FIG. 1 is a section view of the joint with the tie back inserted into the receptacle and prior to expansion.

Referring to FIG. 1, a liner top or other body 10 has a receptacle 12. The receptacle 12 may be polished. A tie back 14 is located at the lower end of a tubing string 16. The outside diameter 18 of the tie back 14 before expansion is less than the inside diameter 20 of the receptacle 12. This dimensional relationship allows for easy insertion of the tie back 14 into the receptacle 12. One or more seals, shown schematically as 22 are secured to the outside diameter as an option. The seal 22 can alternatively be secured to the receptacle 12. The wall thickness 24 is not reduced to apply the seal 22. The wall thickness 24 may be initially oversized for the intended pressure rating to compensate for any thinning of the wall during the expansion process. Alternatively, the seal 22 can be omitted and sealing contact between surfaces 26 and 28 can occur through expansion tool 30, which is show schematically in FIG. 1. The wall thickness 24 may be constant. However, even the use of a seal 22 will not require a wall thickness reduction for such items as recesses or grooves that could decrease the pressure rating of the finished connection. Those skilled in the art will appreciate that a variety of known swage assemblies can be used. The expansion tool 30 can be delivered with the tubing 16 and the expansion initiated when the tie back 14 is inserted into the receptacle 12. Alternatively, the expansion tool can be delivered in a separate trip, through tubing 16.

Figure 2:
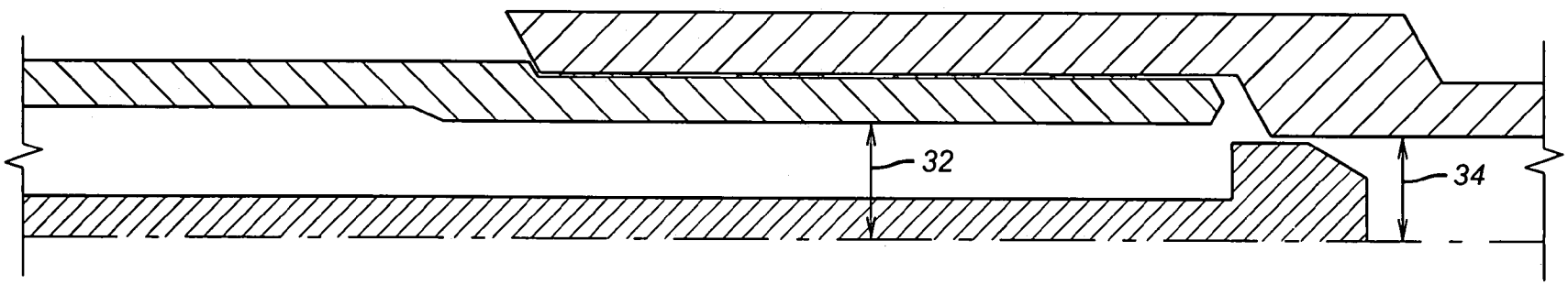
FIG. 2 is the view of FIG. 1 after expansion of the tie back.

As shown in FIG. 2, after expansion the seal 22, if used, is compressed between surfaces 26 and 28. The inside diameter 32 of the tie back 14 is at least equal to or greater than the diameter 34 immediately adjacent the receptacle 12. With the tubing 16 secured to the body 10, the expansion tool 30 can now be withdrawn through the tubing 16.

Figure 3:
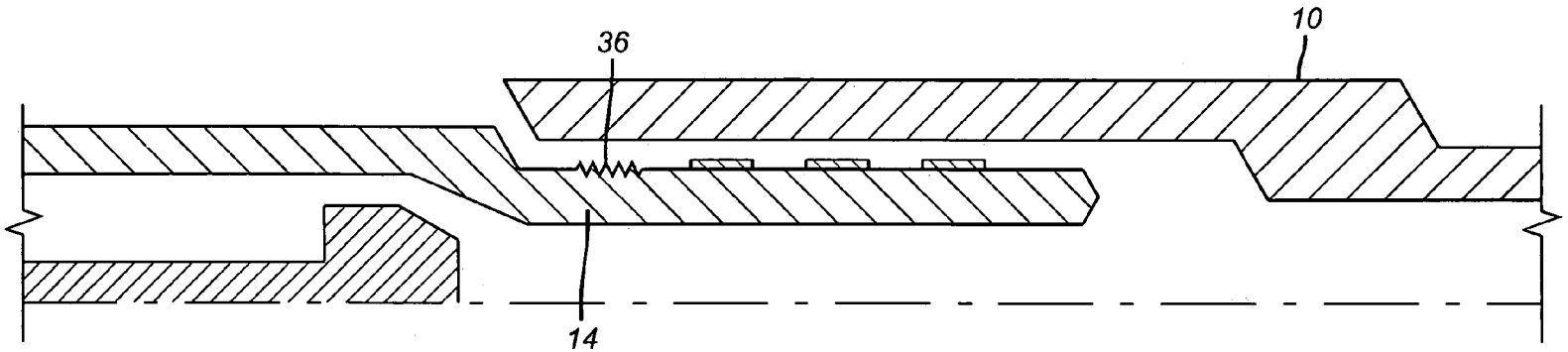
FIG. 3 is a run in view showing one form of grip enhancement.
Figure 4:
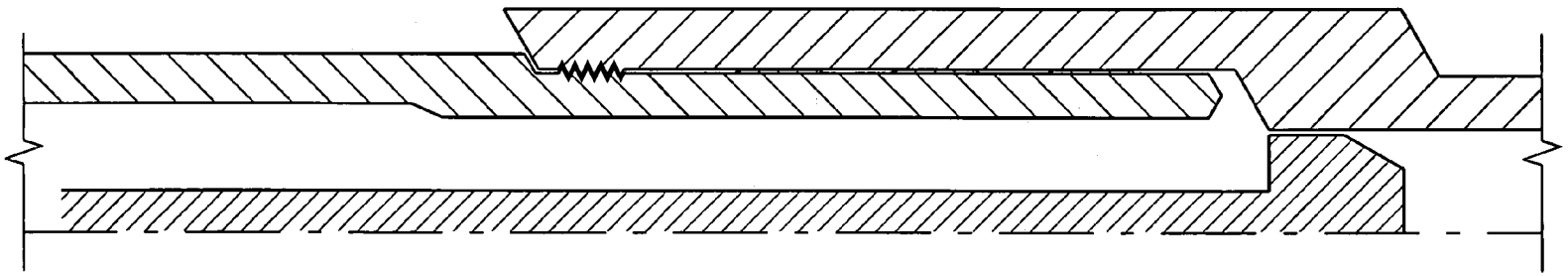
FIG. 4 is the view of FIG. 3 in the expanded position.
Figure 5:
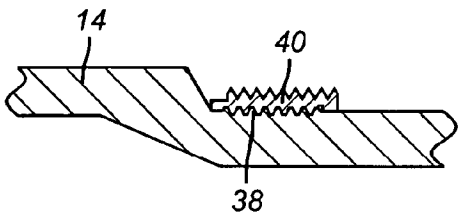
FIG. 5 shows a thread form of a grip enhancer.
Figure 6:
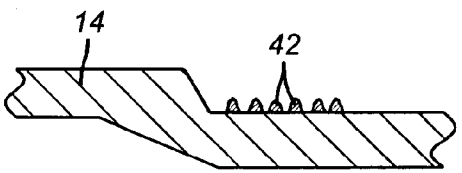
FIG. 6 shows a surface roughness form of a grip enhancer.

Referring to FIG. 3, the tieback 14 or the body 10 can further include a profile 36 designed to penetrate the opposing member at expansion. The penetration is shown in FIG. 4. The profile 36 can be a series of parallel rings, a thread, a regular or irregular pattern of projections and/or depressions. Is can be on either member or on both and if on both the projection 36 on each member could be aligned or misaligned. As shown in FIG. 5, a thread 38 can be added to either body, although shown on the tieback 14. A ring, either whole or split or segments banded together 40 can be secured to thread 38. Alternatively, as shown in FIG. 6, a surface roughness 42 can be created preferably of randomly positioned carbide particles or equivalent hard material that will preferably penetrate the opposing body in expansion. The roughened surface can be on either body or both and if on both, the sections treated can be in alignment or can be misaligned. Similarly, the threaded ring 40 option shown in FIG. 5 can be on one body or both, although it is preferred to put it on the tieback 14 so as to avoid removing material from body 10. If the threaded ring 40 is on both bodies its placement can be aligned or misaligned.

Figure 7:
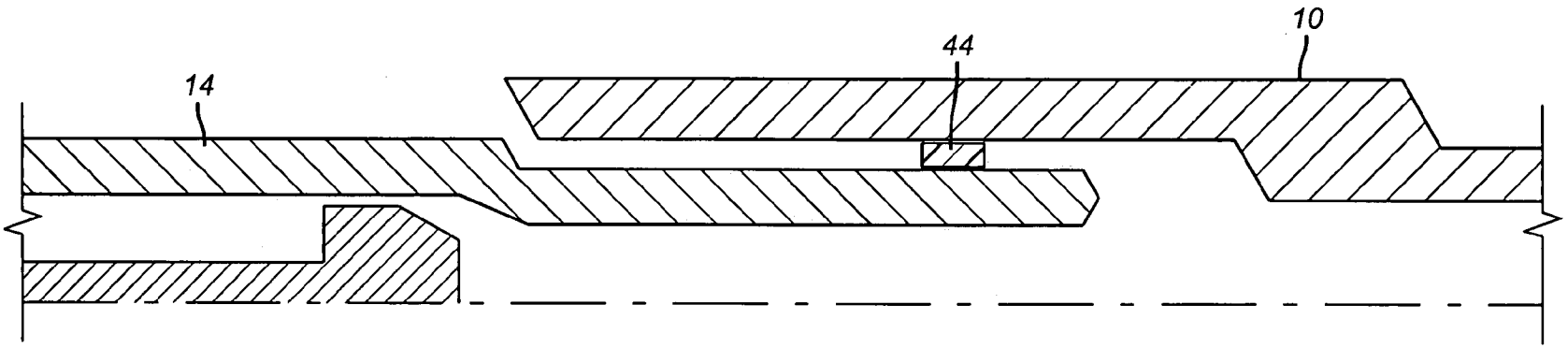
FIG. 7 shows an alternative embodiment illustrating the use of a temporary seal, in the run in position.
Figure 8:
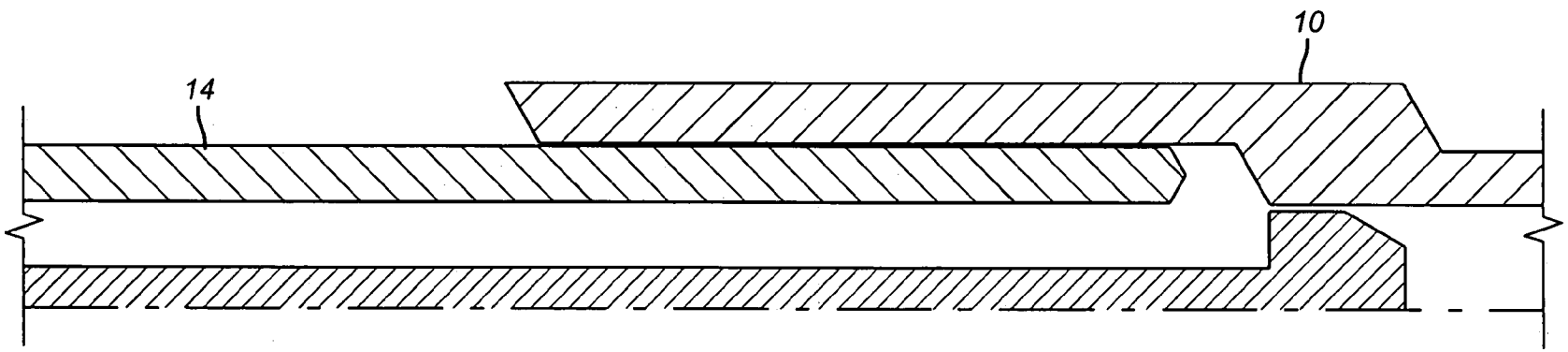
FIG. 8 is the view of FIG. 7 in the expanded position.

Referring now to FIG. 7, a temporary seal 44 is installed on tieback 14. This seal makes contact with the receptacle 12 during run-in. Its purpose is to allow a surface signal that the connection is made. It doesn't have to hold pressure perfectly and it is possible that it may be extruded out as a result of expansion, shown in FIG. 8. Once the tieback 14 is in the receptacle 12 the surface personnel can build pressure and know the connection is made by seeing a pressure buildup at the surface. It should be noted that the seals 22 shown in FIG. 1 will not make receptacle 12 contact when the tieback is inserted. Seal 44 can be used with or without seals 22. As shown in FIG. 8, the expansion alone can result in the seal even if the temporary seal 44 is squeezed out during expansion.

Figure 9:
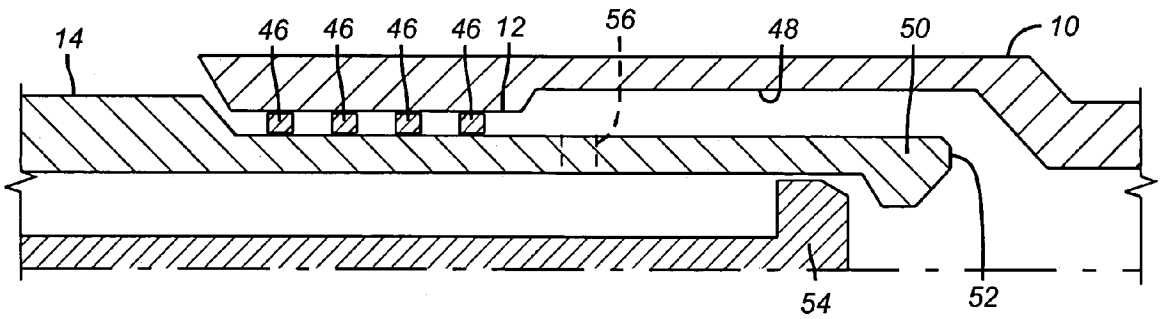
FIG. 9 is an alternative embodiment showing seals that engage on insertion and a retainer activated by an expansion tool, in the run in position.
Figure 10:
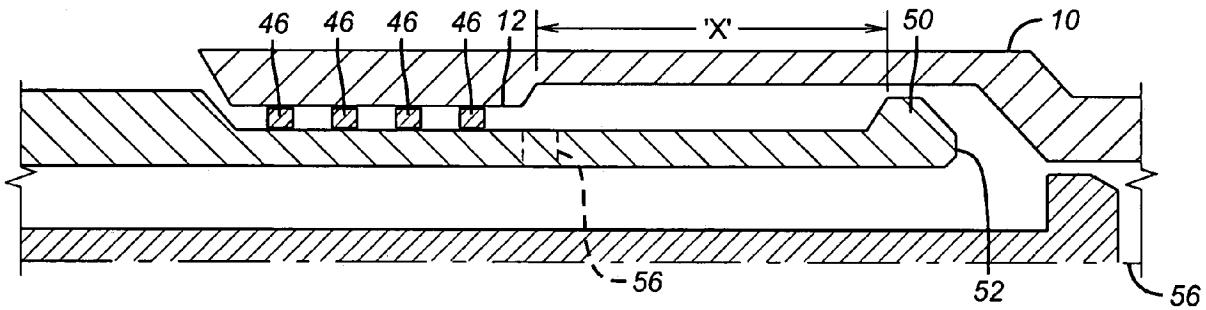
FIG. 10 is the view of FIG. 9 with the retainer engaged in the groove after expansion.
Figure 11:
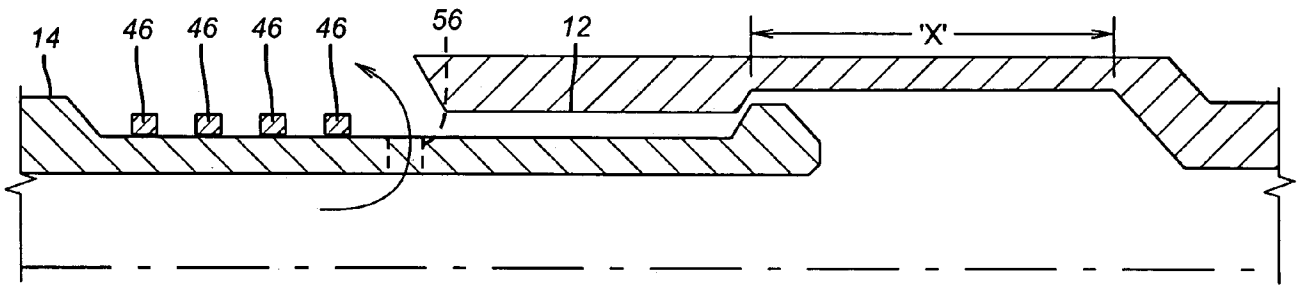
FIG. 11 is the view of FIG. 10 with the seals pulled out and a port exposed for cement passage, while the retainer still holds the connection together.

Turning now to FIGS. 9–11, the tieback 14, comprises on or more seals 46, although four are shown. These seals engage the receptacle 12 upon insertion. Many operators like to pump cement into the receptacle 12 after initially inserting the tieback 14 and then temporarily pulling it out. The problem that occurs when the cold cement is pumped into the receptacle 12 the tieback 14 shrinks in length to the point that the connection can come completely apart. Ideally, the operator only wants to get the seals 46 out of the receptacle 12 when the cement is pumped but not any further. The contraction due to the cement pumping made the connection come further apart than was desirable, so that re-insertion of the tieback 14 into the receptacle 12 could create a problem. Timing was important during this procedure because the cement was setting up. To solve this problem the body 10 is provided with a recess 48. The tieback 14 has an inwardly oriented projection 50 preferably near its lower end 52. When the expansion tool 54 is advanced past projection 50 it reverses the orientation of projection 50 so that it looks away from the central axis 56 and into recess 48. A port 56 is provided in tieback 14. As shown in FIG. 11, the tieback 14 can be pulled up until projection 50 catches in an end of recess 48. In that position, port or ports 56 are exposed for cement flow and the seals 46 are out of the receptacle 12. However, the connection is not fully apart and can't come apart even due to shrinkage from the flowing cold cement. Instead, a tensile stress develops in the tieback 14 that is resisted by projection 50 engaging the recess 48. After the cement is pumped and before it sets, weight is set down on the tieback 14 to reinsert the seals 46.

The foregoing disclosure and description of the invention are illustrative and explanatory thereof, and various changes in the size, shape and materials, as well as in the details of the illustrated construction, may be made without departing from the spirit of the invention.

I claim:

1. A method of connecting a tie back of a tubing string to a receptacle located downhole, said receptacle comprising a tubular shape defining a wall having an internal dimension and that features a change in said internal dimension of the wall, comprising:

connecting a tie back having at least one port thereon to the lower end of a string;

running the string into the wellbore;

inserting the tieback into the receptacle; and expanding the tieback by plastically deforming it into the receptacle while leaving said port unobstructed.

2. The method of claim 1, comprising:

providing sealing contact from said expansion.

3. The method of claim 1, comprising:

providing an inside diameter on said tie back after expansion that is at least as large as the inside diameter adjacent said receptacle.

4. The method of claim 1, comprising:

running in an expansion tool with said string in a single trip.

5. The method of claim 1, comprising: running in an expansion tool with said string in a separate trip.

6. The method of claim 1, comprising:

plastically deforming said tie back;

elastically expanding the receptacle so as to leave a residual compressive force exerted by the receptacle on said tie back.

7. The method of claim 1, comprising:

providing a constant wall thickness on said tie back.

8. The method of claim 1, comprising:

providing a greater unexpanded wall thickness than needed to meet a predetermined pressure rating;

reducing the wall thickness from said expansion such that the remaining wall thickness still delivers the desired pressure rating.

9. The method of claim 1, comprising:

providing a raised profile on at least one of said tieback and said receptacle;

forcing said raised profile to penetrate an opposing surface due to said expansion.

10. The method of claim 9, comprising:

providing as said profile one or more of parallel ridges, a threaded ring and carbide inserts.

11. The method of claim 1, comprising:

providing at least one seal on at least one of said tie back and said receptacle;

engaging said seal in the receptacle from said expanding.

12. The method of claim 11, comprising:

providing a raised profile on at least one of said tieback and said receptacle;

forcing said raised profile to penetrate an opposing surface due to said expansion.

13. The method of claim 11, comprising:

mounting said seal on said tieback without reducing its wall thickness to accommodate said seal.

14. The method of claim 13, comprising: using a coating on said tie back as said seal.

15. A method of connecting a tubing string to a receptacle located downhole, comprising:

connecting a tie back to the lower end of a string;

running the string into the wellbore;

inserting the tieback into the receptacle;

expanding the tieback into contact with the receptacle;

providing a temporary seal on at least one of said tieback and said receptacle to make temporary sealing contact upon insertion of said tieback into said receptacle;

building pressure in said tieback;

holding pressure with said temporary seal;

using built up pressure as a surface signal that said tieback is inserted into said receptacle.

16. The method of claim 15,comprising:

pushing out said temporary seal due to expansion.

17. The method of claim 15, comprising:

providing at least one seal on at least one of said tie back and said receptacle;

engaging said seal in the receptacle from said expanding.

18. The method of claim 17, comprising:

providing a raised profile on at least one of said tieback and said receptacle;

forcing said raised profile to penetrate an opposing surface due to said expansion.

19. The method of claim 15, comprising:

providing a raised profile on at least one of said tieback and said receptacle;

forcing said raised profile to penetrate an opposing surface due to said expansion.

20. A tie back on the lower end of a tubular string extending from the surface to a location downhole, comprising:

a tubular body defining an inside wall and comprising a receptacle in said wall, said wall having an internal dimension and said receptacle defined by a change in said internal dimension of the wall;

a tie back member,formed on the lower end of the tubular string, and insertable into said receptacle without interference and engaging the receptacle for sealing therewith only after expansion; and the inside diameter of said tieback measured in said receptacle, after expansion of that portion of the tieback that is within said receptacle, is at least as great as the inside diameter of said body measured adjacent said receptacle.

21. The connection of claim 20, wherein:

said tie back member is devoid of any groove that might reduce its pressure rating when sealed to said receptacle.

22. The connection of claim 20, wherein:

said receptacle member is devoid of any groove that might reduce its pressure rating when sealed to said tie back.

23. The connection of claim 21,further comprising:

at least one seal on the outer periphery of said tie back member.

24. A method of connecting a tubing string to a receptacle located downhole, comprising:

connecting a tie back to the lower end of a string;

running the sting into the wellbore;

inserting the tieback into the receptacle;

engaging at least one seal between said tieback and said receptacle by said inserting;

expanding at least a portion of said tieback into a slidable locking relation with said receptacle.

25. The method of claim 24, comprising:

providing a projection on said tieback that is initially oriented toward its longitudinal axis;

using the expansion tool to reverse the orientation of said projection toward a groove in said receptacle.

26. The method of claim 24, comprising:

disengaging said seal while retaining said tieback to said receptacle.

27. The method of claim 26, comprising:

providing at least one port on said tieback between said locking portion of said tieback and said seal;

selectively exposing said port out of said receptacle while retaining said tieback to said receptacle.

28. The method of claim 27, comprising:

pumping a sealing material through said port when said port is exposed outside said receptacle;

reinserting said port and said seals into said receptacle after said pumping.

* * * * *